United States Patent [19]

Nomura

[11] 3,965,684

[45] June 29, 1976

[54] DEVICE FOR CONTROLLING SPEED OF TURBINE

[75] Inventor: Masahide Nomura, Hitachi, Japan

[73] Assignee: Hitachi, Ltd., Japan

[22] Filed: Jan. 21, 1975

[21] Appl. No.: 542,822

[30] Foreign Application Priority Data

Jan. 23, 1974 Japan ..... 49-9311

[52] U.S. Cl. ..... 60/660

[51] Int. Cl.[2] ..... F01K 13/02

[58] Field of Search ..... 415/17, 30, 36, 13, 415/15; 60/660–667

[56] References Cited

UNITED STATES PATENTS 3,340,883 9/1967 Paternal ..... 415/17 X

*Primary Examiner*—Allen M. Ostrager

*Attorney, Agent, or Firm*—Craig & Antonelli

[57] ABSTRACT

A speed control device is constituted of an acceleration control device used for starting a turbine, a constant speed control device used for the constant speed operation of the turbine and a selection circuit for selecting that one of the outputs of the control devices which makes smaller the opening of an adjustable valve provided at the entrance of the turbine. The output of the selection circuit determines the opening of the valve. The speed control device is so designed that the speed regulation may affect only the loop gain of the constant speed control system. For this purpose, the speed regulation circuit is provided, for example, between the subtractor of the constant speed control device and the selection circuit.

11 Claims, 8 Drawing Figures

DEVICE FOR CONTROLLING SPEED OF TURBINE

The present invention relates to a device for controlling the speed of a steam turbine used in a heat power plant or an atomic power plant, and more particularly to a device which comprises an acceleration control device to process the starting transient of the turbine and a constant speed control device to adjust constant the speed of the turbine when the turbine is in the steady state, and in which the opening of the adjustable valve is determined by selecting and using one of the outputs of the acceleration and the constant speed control devices, to control the speed of the turbine.

In such a turbine speed control device as mentioned above, the structure of the acceleration control device is for example as follows. First, the actual speed $Sa$ of the turbine is detected and differentiated by a differentiator so that the actual acceleration $Aa$ of the turbine is detected. The actual acceleration $Aa$ is compared with a predetermined acceleration $Ar$ in a first subtractor so that the deviation $Ea$ of the actual acceleration $Aa$ from the predetermined one $Ar$ is derived. The deviation $Ea$ of the acceleration is integrated by an integrator and as a result converted to a speed deviation signal $Esu$. The output $Esu$ of the integrator is the output of the acceleration control device in question. On the other hand, the actual speed $Sa$ is compared with a predetermined turbine speed $Sr$ in a second subtractor so that the deviation $Ess$ of the actual speed $Sa$ from the predetermined one $Sr$ is derived. The output $Ess$ of the second subtractor is the output of the constant speed control device under consideration. The output $Esu$ of the acceleration control device and the output $Ess$ of the constant speed control device are applied to a selection device. The output $Es$ of the selection device is the result of such a selection that the opening of the adjustable valve is smaller for the output $Es$. Namely, the output $Esu$ of the integrator becomes the output $Es$ when the turbine is accelerating while the output $Ess$ of the second subtractor is the output $Es$ when the turbine is substantially in the steady state. The output $Es$ of the selection device is then multiplied by a predetermined gain to determine the speed regulation and finally used as a signal to determine the opening of the adjustable valve at the entrance of the turbine.

Such a composite speed control device as described above can be very simply constructed by employing a static system using recent electronic elements and the control device as a hardware can be easily fabricated. Namely, in the part of an acceleration control device, the input terminal of the series circuit of an operational amplifier $A_1$ and a diode $D_1$ is connected with a resistor $R_1$ and the series circuit of a resistor $R_2$ and a capacitor $C_1$, and the series circuit of the operational amplifier $A_1$ and the diode $D_1$ is shunted by a series circuit of a resistor $R_5$ and a capacitor $C_2$, and a signal representing the predetermined acceleration $Ar$ is applied to the resistor $R_1$ while a signal representing the actual speed $Sa$ is applied to the series circuit of the resistor $R_2$ and the capacitor $C_1$. On the other hand, in the part of a constant speed control circuit, the input terminal of the series circuit of an operational amplifier $A_2$ and a diode $D_2$ is connected with a resistor $R_3$ and a resistor $R_4$, the series circuit of the operational amplifier $A_2$ and the diode $D_2$ is shunted by a resistor $R_6$, and the signal representing the actual turbine speed $Sa$ is applied to the resistor $R_3$ while a signal representing the predetermined turbine speed $Sr$ is applied to the resistor $R_4$. The output terminals of the series circuit of $A_1$ and $D_1$ and the series circuit of $A_2$ and $D_2$ are commonly connected and further connected both with a power source through a resistor $R_7$ and with a circuit for controlling the adjustable valve through a resistor $R_{10}$. Here, the series circuit of $C_1$ and $R_2$ constitutes a differentiator, the series circuit of $R_5$ and $C_2$ forms an integrator, and the circuit consisting of $D_1$, $D_2$ and $R_7$ serves as a selection circuit. The two input circuits for each of the operation amplifiers $A_1$ and $A_2$ serve as a subtractor since the phases of the signal applied to the circuits can be made opposite to each other at the output ends, and the speed regulation is determined by the resistor $R_{10}$.

The speed regulation is defined as a percent ratio of the speed deviation to the rated speed, at which speed deviation it is required to change the adjustable valve from full load position to no load position during the normal operation of the turbine. Namely, for example, a speed regulation of 5% means that when the turbine speed increases by 5% at full load operation, the valve is driven to the completely closed position. The speed regulation will be determined according to the operating policy of each power plant. In order to contribute to the stability of the power system (generally in order for a small capacity machine to be used for this purpose), it is necessary to decrease the speed regulation and to immediately control the adjustable valve in response to the variation in frequency so as to prevent the variation. On the other hand, as in the case of a large capacity machine, in order to perform the base load operation, it is necessary to increase the speed regulation and to prevent the motion of the valve so that a constant load operation may be performed even if the frequency varies to some degree.

The speed control device described here is usually employed in a large capacity power installation and the speed regulation is set large for the base load operation.

Now, power systems have a tendency of growing large in power supply capacity and it is expected in the near future that even a large capacity machine should not be operated under the base load condition but so operated as to follow the change in the system. In such a case, the speed regulation is to be lowered. In the above described speed control device, however, the resistor $R_{10}$ to change the speed regulation is provided at the output terminal of the selection device and the variation in the resistance causes an unstable state. Namely, the speed regulation is involved only when the turbine is operated at a constant speed and therefore useless when the acceleration of the turbine is controlled. Accordingly, if an acceleration control system is so designed that its loop gain may be optimum for a speed regulation of 5%, then the speed response at the acceleration control of the turbine is oscillatory for a speed regulation of 3% while for a speed regulation of 7% the speed response at the acceleration control of the turbine is stabilized but the response to the preset signal becomes slower. Thus, since in the conventional speed control device the resistor $R_{10}$ to determine the speed regulation is provided at the output end of the selection device, there is a problem that when the speed regulation is changed, the control characteristic of the acceleration control device is degraded.

It is therefore the object of the present invention, which has been made to eliminate such drawbacks of the conventional speed control device as described above, to provide a speed control device in which the acceleration control device is not affected even when the speed regulation is changed so that the turbine can be stably and quickly accelerated.

According to the present invention to attain the above-mentioned object, there is provided a device for controlling the speed of a turbine, comprising a constant speed control device which receives the output of a detector for detecting the speed of the turbine and a preset turbine speed signal so as to adjust the speed of the turbine to a predetermined value; an acceleration control device which receives the output of said detector and a preset turbine acceleration signal so as to adjust the acceleration of the turbine to a predetermined value; an adjustable valve provided at the entrance of said turbine; a selection circuit which receives the outputs of said constant speed and said acceleration control devices and selects one of said outputs which makes the opening of said adjustable valve smaller; and a means for determining the opening of said valve according to the output of said selection circuit, wherein the speed regulation circuit for determining the rate of change in the turbine output with respect to the turbine speed is provided in such a place that the change in the speed regulation affects only the constant speed control system consisting of said constant speed control device, said selection circuit, said valve-opening determining means, said adjustable valve and said speed detector.

Briefly speaking, according to the present invention, there is provided a speed control device comprising a constant speed control device, an acceleration control device and a selection device for selecting one of the outputs of the constant speed and the acceleration control devices, wherein the change in the speed regulation causes the variation only in the loop gain of the constant speed control system.

Other features, objects and advantages of the present invention will be apparent when one reads the following description of the specification with the aid of the accompanying drawings, in which.

Figure 2:
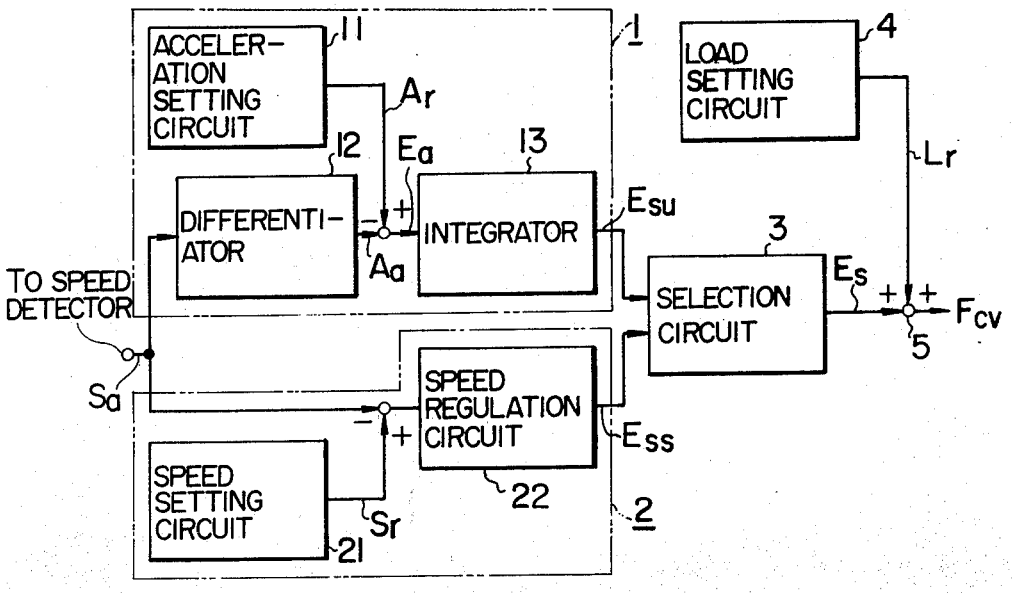
FIG. 2 is a block diagram of a speed control device as one embodiment of the present invention, in which a speed regulation circuit is provided between a selection circuit and the subtractor of a constant speed control circuit.
Figure 3:
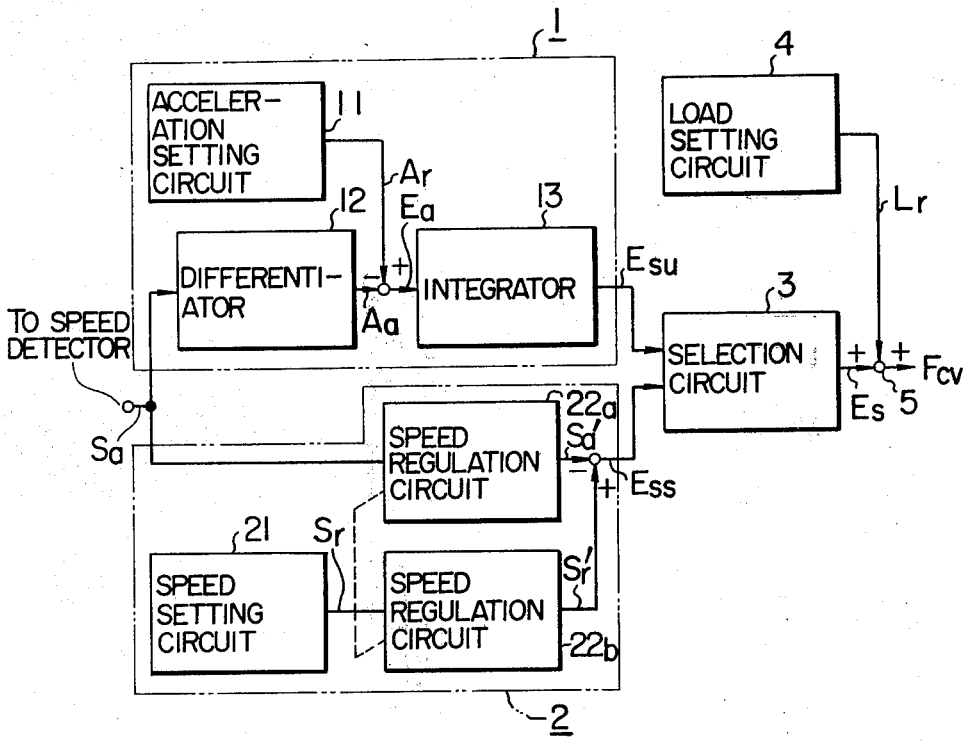
FIG. 3 is a block diagram of a speed control device as a second embodiment of the present invention, in which a pair of speed regulation circuits are provided at the two inputs of the subtractor of a constant speed control circuit so as to operate them together in proportional fashion.
Figure 4:
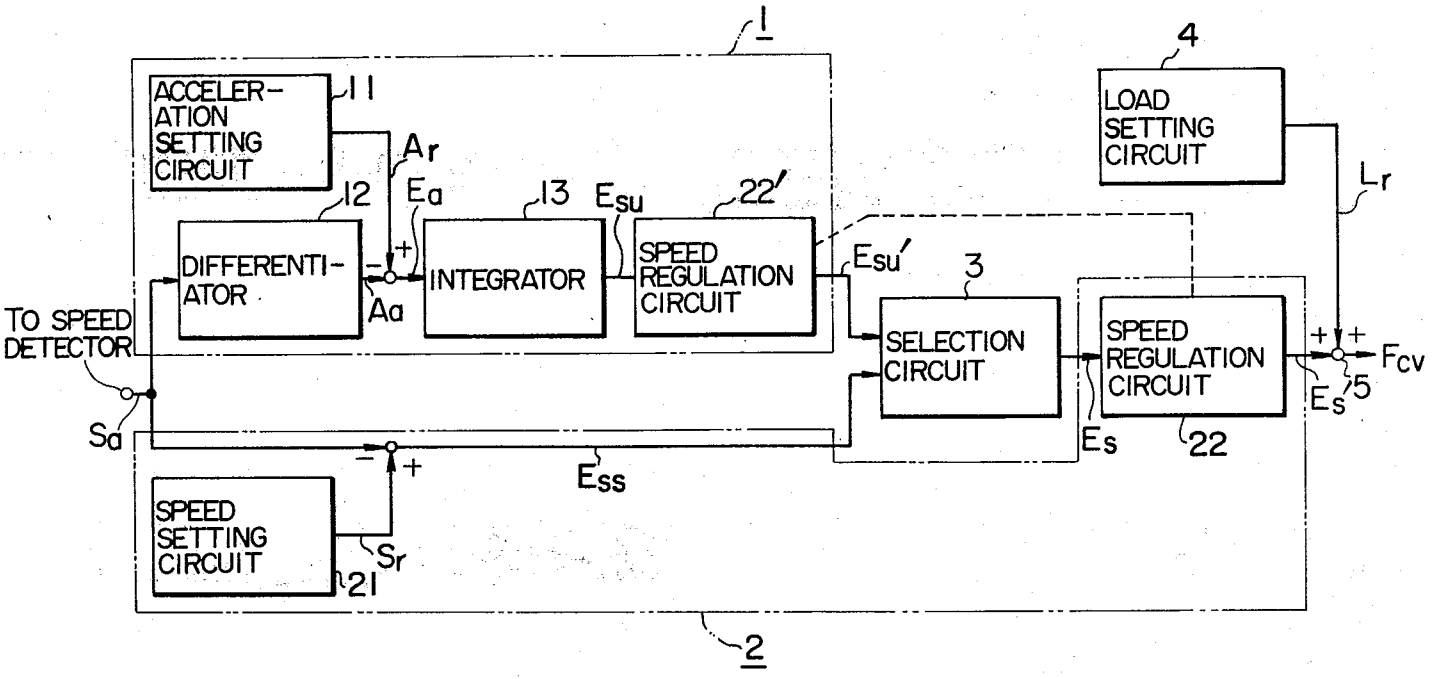

FIG. 4 is a block diagram of a speed control device as a third embodiment of the present invention, in which a speed regulation circuit is connected with the output of a selection circuit and another speed regulation circuit is connected with the output of an acceleration control circuit, both the speed regulation circuits being operated in inverse-proportional fashion; and FIGS. 5, 6, 7 and 8 show respectively concrete circuits of the block diagrams shown in FIGS. 1, 2, 3 and 4.

Figure 1:
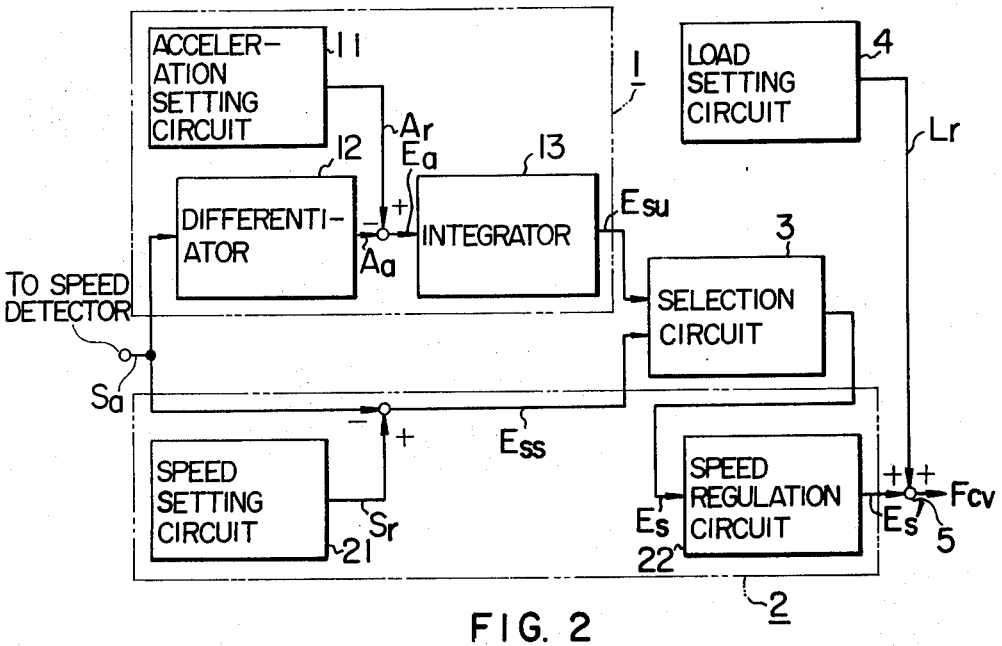
FIG. 1 PRIOR ART
FIG. 1 is a block diagram of the general structure of a speed control device to which the present invention is applied.

FIG. 1 is a block diagram of the general structure of a speed control device to which the present invention is applied, and the principle of the present invention will be described with reference to FIG. 1. As shown in FIG. 1, the device for controlling the speed of a turbine is a composite control device constituted of an acceleration control device 1 and a constant speed control device 2. The acceleration control device 1 compares the present acceleration $Ar$ set by an acceleration setting circuit 11, with the acceleration $Aa$ of the turbine derived by differentiating the actual speed $Sa$ of the turbine by a differentiator 12, so that an acceleration deviation signal $Ea$ is first produced. The acceleration deviation signal $Ea$ is then integrated by an integrator 13 to produce a speed deviation signal $Esu$, which is delivered to a selection circuit 3. In the constant speed control circuit 2, the preset speed $Sr$ set by a speed setting circuit 21 is compared with the actual speed $Sa$ of the turbine to produce a speed deviation signal $Ess$, which is delivered to the selection circuit 3. The selection circuit 3 serves to preferentially deliver a smaller one of the two inputs from the just preceding stages, and the output $Es$ of the selection signal is used to make the opening of the adjustable valve smaller. Namely, the output $Es$ is corrected by a speed regulation circuit 22, then combined in an adder 5, with the generator load component $Lr$ given from a load setting circuit 4, and finally applied to a steam adjusting valve at the entrance of the turbine to determine the opening of the valve. In this way, the turbine speed is controlled by that one of the outputs of the acceleration control circuit 1 and the constant speed control device 2, which makes the opening of the adjustable valve smaller. And, when the turbine at rest is started, the turbine acceleration is first determined by the output of the acceleration control circuit 1 and when the predetermined speed is reached, the turbine speed is controlled by the output of the constant speed control circuit 2.

With this structure, the degradation of controllability caused when the speed regulation is changed during the accelerating period of the turbine, is due to the speed regulation circuit being located at the output end of the selection circuit. According to the present invention, however, the change in the speed regulation is accompanied only by the variation in the loop gain of the constant speed control system. A first measure is to provide a speed regulation circuit 22 between the subtractor of the constant speed control circuit 2 and the selection circuit 3, as shown in FIG. 2. A second measure is, as shown in FIG. 3, to provide speed regulation circuits 22*a* and 22*b* so that the actual speed signal $Sa$ and the preset speed signal $Sr$ may be multiplied by predetermined speed regulations and that the resulting outputs $Sa'$ and $Sr'$ may be applied to a subtractor. The speed regulations given here by the circuits 22*a* and 22*b* are proportionally related to each other. A third measure is as shown in FIG. 4 in which a speed regulation circuit 22′ is provided between the integrator 13 of the acceleration control circuit 1 and the selection circuit 3 so that the gain of the circuit 22′ is in inverse-proportional relation to the gain of the circuit 22. Although there are several different measures as described above, the gist of the measures is that the change in the speed regulation causes only the variation in the loop gain of the constant speed control system. Here, the term "constant speed control system" means closed circuitry consisting of the constant speed control device, the selection circuit 3, the adder 5 and the adjustable valve (not shown) of the turbine. In FIGS. 2, 3 and 4, the same reference numerals and characters are applied to like parts or circuit elements as in FIG. 1 and the once mentioned elements are not described again.

Figure 5:
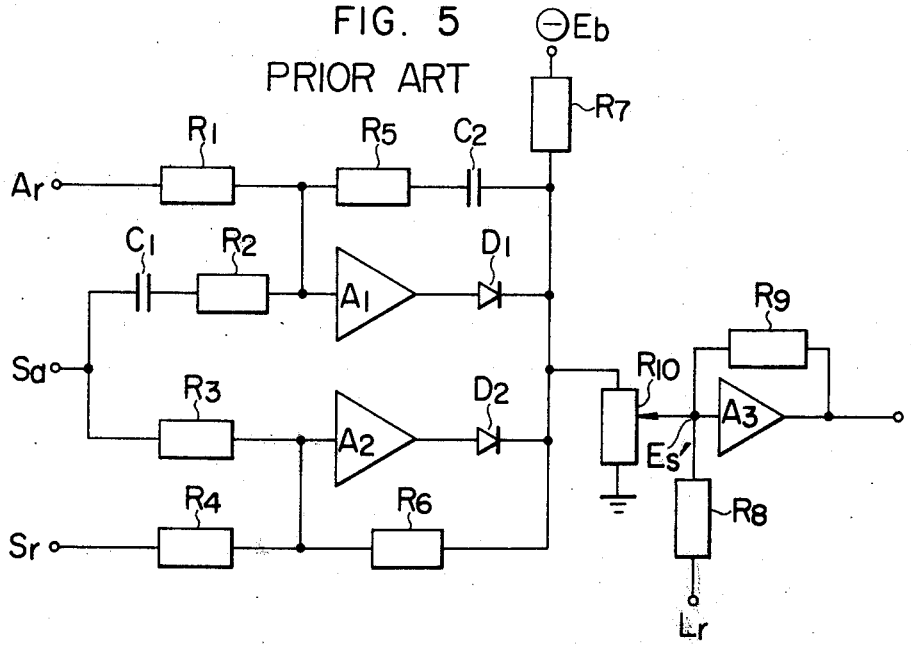
FIG. 5 PRIOR ART

FIGS. 5 to 8 show the concrete circuits of the block diagrams shown in FIGS. 1 to 4, respectively. In FIG. 5 which corresponds to FIG. 1, the differentiator 12 is a series circuit of a capacitor $C_1$ and a resistor $R_2$, the integrator 13 is a series circuit of a resistor $R_5$ and a capacitor $C_2$, and the selection circuit 3 consists of a resistor $R_7$ and diodes $D_1$ and $D_2$. The speed regulation circuit 22 is a variable resistor $R_{10}$ and the deviation of $Aa$ from $Ar$ or the deviation of $Sa$ from $Sr$ is obtained by applying voltages having opposite polarities to the input of operational amplifiers $A_1$ and $A_2$. The selection circuit selects the output which makes the opening of the adjustable valve of the turbine smaller. If the output to make smaller the opening of the valve is defined to be an output having a smaller level, the selection circuit can be constructed as a lower level preference circuit. The diodes of the selection circuit have their anodes connected with the outputs of the operational amplifiers and their cathodes connected through the resistor $R_7$ with a power source $Eb$. The power source $Eb$ has a negative polarity to form the lower level preference circuit. The voltage of the source $Eb$ is chosen to be lower than any voltage which may appear at the cathode of the diode $D_1$ or $D_2$. Resistors $R_8$ and $R_9$ and an operational amplifier $A_3$ forms a summing circuit for adding a generator load component $L_r$. In FIG. 5, the speed regulation circuit 22 mentioned with FIG. 1 corresponds to a resistor $R_{10}$. By making the resistor $R_{10}$ variable, the output $Es'$ with respect to the inputs $Sa$ and $Sr$ applied to the operational amplifier $A_2$ is changed. The relationship of $Es'$ to $Sa$ and $Sr$ is given by the following equation:

$$Es' = -\left(Sr \times \frac{R_6}{R_4} - Sa \times \frac{R_6}{R_3}\right) K = KR_6 \left(\frac{Sa}{R_3} - \frac{Sr}{R_4}\right) \quad (1)$$

On the other hand, the relationship of $Es'$ to $Ar$ and $Sa$ is as follows.

$$Es' = -\left[Ar \cdot \frac{1 + SR_5C_2}{SR_1C_2} - Sa \cdot \frac{C_1(1 + SR_5C_2)}{C_2(1 + SR_2C_1)}\right] K$$
$$= K(1 + SR_5C_2) \cdot \left[\frac{C_1Sa}{C_2(1 + SR_2C_1)} - \frac{Ar}{SR_1C_2}\right] \quad (2)$$

In the above formulae (1) and (2), $C_1$, $C_2$, $R_1$ and $R_2$ are assumed to refer directly to capacitances and resistances, "S" indicates the operator in Laplace transform, and "K" designates the gain, i.e. speed regulation, of the resistor $R_{10}$. Moreover, the operational amplifiers $A_1$ and $A_2$ are sign-inverting operational amplifiers.

As apparent from the formulae (1) and (2), the speed regulation K has an influence upon the speed of the turbine in both cases when the turbine is at an accelerating state and at a constant speed. It is therefore understood that the control characteristic of the acceleration control system becomes unstable if the speed regulation K is changed.

Figure 6:
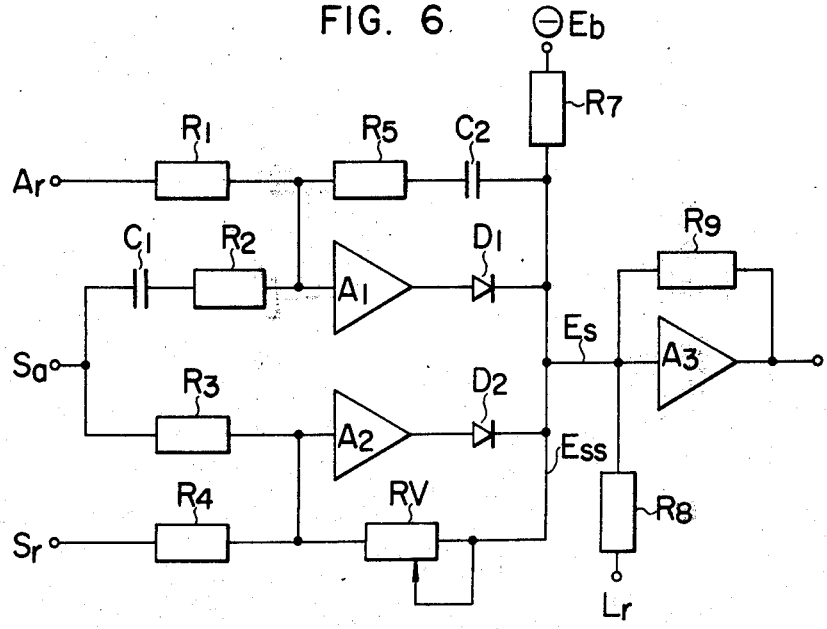

In FIG. 6 corresponding to FIG. 2, the same reference characters are applied to the equivalent elements as in FIG. 5. Here, the resistor $R_{10}$ shown in FIG. 5 is eliminated, and instead a feedback resistor RV for the operational amplifier $A_2$ is made variable. The relationship of $Es$ to $Sa$ and $Sr$ is given by the formula:

$$Es = -\left(Sr \times \frac{RV}{R_4} - Sa \times \frac{RV}{R_3}\right) = RV\left(\frac{Sa}{R_3} - \frac{Sr}{R_4}\right) \quad (3)$$

The relationship of Es to Ar and Sa is expressed as follows.

$$Es = -\left[Ar \cdot \frac{1 + SR_5C_2}{SR_1C_2} - Sa \cdot \frac{C_1(1 + SR_5C_2)}{C_2(1 + SR_2C_1)}\right]$$
$$= (1 - SR_5C_2)\left[\frac{C_1Sa}{C_2(1 + SR_2C_1)} - \frac{Ar}{SR_1C_2}\right] \quad (4)$$

If the resistance of the variable resistor RV is changed in the formula (3), the speed regulation is equivalently changed so that a constant speed control device having the same effect as the circuit shown in FIG. 5 can be obtained. Moreover, the formula (4) is independent of the speed regulation RV (proportional to K), and if the capacitances in the formula (4) are optimally chosen, optimal acceleration is always possible. In comparison with the formula (1), it is seen that K and RV are in proportion to each other, and the speed regulation can be decreased by decreasing RV.

Figure 7:
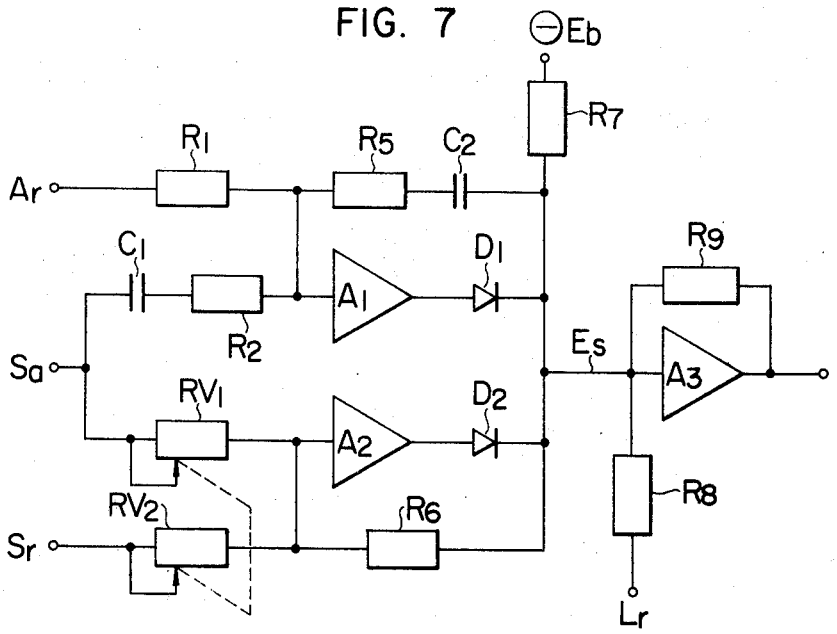

FIG. 7 corresponds to FIG. 3 and in FIG. 7 the same reference characters are applied to the equivalent elements as in FIG. 5. In FIG. 7, the resistor $R_{10}$ shown in FIG. 4 is eliminated, and instead the input resistances $RV_1$ and $RV_2$ for the operational amplifier $A_2$ are made variable. In this case, the relationship of Es to Sa and Sr is as follows.

$$Es = -\left(Sr \times \frac{R_6}{RV_2} - Sa \times \frac{R_6}{RV_1}\right) = \frac{R_6}{RV_1}\left(Sa - \frac{Sr}{R_0}\right) \quad (5)$$

where the ratio of $RV_2$ to $RV_1$, viz. $RV_2/RV_1 = R_0$.

Also, the relationship of Es to Ar and Sa is similar to that represented by the formula (4) which is independent of the speed regulation K. So, if the capacitances in the formula (5) are optimally chosen, optimal acceleration is always possible. In comparing the formula (5) with the formula (1), it is seen that K and $RV_1$ are in proportional relation to each other. Accordingly, if $RV_1$ and $RV_2$ are increased in inverse proportion to K, the speed regulation is decreased so that the same constant speed control as with the circuit in FIG. 6 can be performed.

Figure 8:
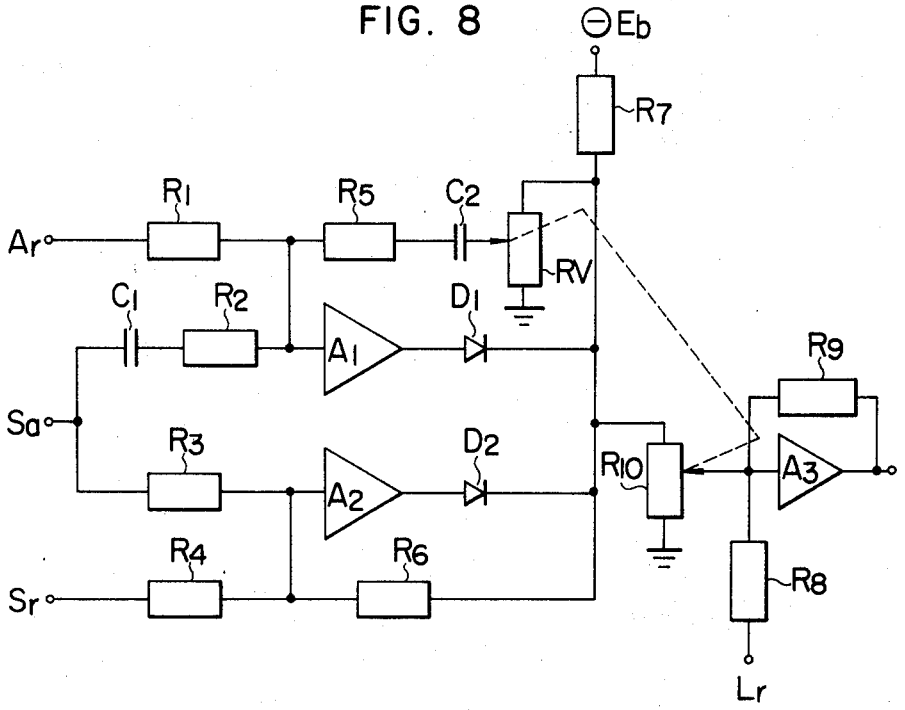

FIG. 8 corresponds to FIG. 4 and also in this figure the same reference characters are applied to the equivalent elements as in FIG. 5. In this circuit, a resistor RV is provided and the resistor RV is changed in gang with the speed regulation circuit (resistor $R_{10}$). In this case, too, the relationship of $Es$ to $Sa$ and $Sr$ is similar to that represented by the formula (1) and the speed regulation can be changed by varying the resistance of the resistor $R_{10}$. The relationship of $Es$ to $Ar$ and $Sa$ is as follows.

$$Es = -K\left[Ar\,\frac{1+SR_sC_2}{SR_1C_2}\cdot K_1 - Sa\,\frac{C_1(1+SR_sC_2)}{C_2(1+SR_2C_1)}\cdot K_1\right]$$
$$= K\cdot K_1(1+SR_sC_2)\left[\frac{C_1Sa}{C_2(1+SR_2C_1)} - \frac{Ar}{SR_1C_2}\right] \quad (6)$$

It is important here that the gain $K_1$ given by the variable resistor RV is chosen such that $K_1 \geq 1$ when the speed regulation K is smaller than unity ($K < 1$). Moreover, RV is so related to $R_{10}$ that the product $K\cdot K_1$ is always a constant. With the product $K\cdot K_1$ constant, the formula (6) is not affected by the change in the speed regulation so that optimal acceleration can be performed. As for the constant speed control device, the formula (1) can be directly applied so that the speed regulation can be changed by varying the resistance of the resistor $R_1$.

As described above with the aid of FIGS. 6, 7 and 8, according to the present invention, the change in the speed regulation causes only the loop gain of the constant speed control system, but does not affect the acceleration control system. Accordingly, the optimal acceleration of the turbine in starting operation can be realized even in the case where the operation to cope with the variation in the frequency of the power system is desired.

What is claimed is:

1. A device for controlling the speed of a turbine, comprising a constant speed control device which receives the output of a detector for detecting the speed of the turbine and a preset turbine speed signal so as to adjust the speed of the turbine to a predetermined value; an acceleration control device which receives the output of said detector and a preset turbine acceleration signal so as to adjust the acceleration of the turbine to a predetermined value; an adjustable valve provided at the entrance of said turbine; a selection circuit which receives the outputs of said constant speed and said acceleration control devices and selects one of said outputs which makes the opening of said adjustable valve smaller; and a means for determining the opening of said valve according to the output of said selection circuit, wherein the speed regulation circuit for determining the rate of change in the turbine output with respect to the turbine speed is provided in such a place that the change in the speed regulation affects only the constant speed control system consisting of said constant speed control device, said selection circuit, said valve-opening determining means, said adjustable valve and said speed detector.

2. A device as claimed in claim 1, wherein said constant speed control device is provided with at least a subtractor for obtaining the deviation of said output of said speed detector from said preset speed signal and said speed regulation circuit is provided at the output end of said subtractor.

3. A device as claimed in claim 2, wherein said speed regulation circuit is a factor multiplying circuit.

4. A device as claimed in claim 1, wherein said constant speed control device is provided with at least two subtractors for obtaining the deviation of said output of said speed detector from said preset speed signal and two speed regulation circuits are provided respectively at the input sides of said two subtractors.

5. A device as claimed in claim 4, wherein said speed regulation circuits are factor multiplying circuits and the factors multiplied by said circuits are related to each other in proportional fashion.

6. As device as claimed in claim 1, wherein said constant speed control device comprises an operational amplifier with a feedback resistor, a first input resistor for applying said output of said speed detector to said operational amplifier and a second input resistor for applying said preset speed signal to said operational amplifier and said speed regulation circuit can vary the rate of the output of said operational amplifier with respect to the two inputs of said operational amplifier.

7. A device as claimed in claim 6, wherein said feedback resistor is variable.

8. A device as claimed in claim 6, wherein said first and second input resistors are variable and the resistances of said resistors are related to each other in proportional fashion.

9. A device as claimed in claim 1, wherein one speed regulation circuit is provided at the output end of said selection circuit and another speed regulation circuit is provided in said acceleration control circuit.

10. A device as claimed in claim 9, wherein said speed regulation circuits are factor multiplying circuits.

11. A device as claimed in claim 1, wherein said acceleration control circuit comprises an operational amplifier having at least a capacitor in its feedback circuit, an input resistor for applying said preset acceleration signal to said operational amplifier, an input circuit having at least a capacitor for applying said output of said speed detector to said operational amplifier and a factor multiplying circuit provided in said feedback circuit, and a speed regulation circuit at the output end of said selection circuit and said factor multiplying circuit in said feedback circuit are related to each other in inverse-proportional fashion.

* * * * *